US005944030A

United States Patent [19]

Kelsey

[11] Patent Number: 5,944,030

[45] Date of Patent: Aug. 31, 1999

[54] HAIR CURLER

[76] Inventor: Martha Kelsey, P.O. Box 768, Fairfield, Iowa 52556

[21] Appl. No.: 08/751,945

[22] Filed: Nov. 19, 1996

[51] Int. Cl.[6] ..... A45D 6/02

[52] U.S. Cl. ..... 132/252; 132/254; 132/268

[58] Field of Search ..... 132/226, 245, 132/250, 251, 252, 254, 268, 264, 266, 273, 248

[56] References Cited

U.S. PATENT DOCUMENTS

| | | | |
|---|---|---|---|
| 189,804 | 4/1877 | Smith | 132/251 |
| 920,439 | 5/1909 | Davis | 132/264 |
| 1,085,083 | 1/1914 | Grosert | 132/245 |
| 1,954,736 | 4/1934 | Katz | 132/226 |
| 2,010,112 | 8/1935 | Schneiderman | 132/268 |
| 2,218,082 | 10/1940 | Caldora | 132/251 |
| 2,847,015 | 8/1958 | Davis | 132/250 |

FOREIGN PATENT DOCUMENTS

| | | | |
|---|---|---|---|
| 17186 | 4/1935 | Australia | 132/264 |
| 853038 | 11/1960 | United Kingdom | 132/266 |

*Primary Examiner*—Todd E. Manahan
*Assistant Examiner*—Eduardo C. Robert
*Attorney, Agent, or Firm*—James C. Nemmers

[57] ABSTRACT

A hair curling device for forming spiral curls. The curling device has an elongated rod containing longitudinally extending grooves with one end being tapered with a retaining shoulder formed at the outer end. A removable funnel-shaped retaining member is fitted over and retained by the shoulder, and an adjustable clip is positioned near the opposite end to prevent the curler from unwinding and for keeping the curler close to the head.

9 Claims, 1 Drawing Sheet

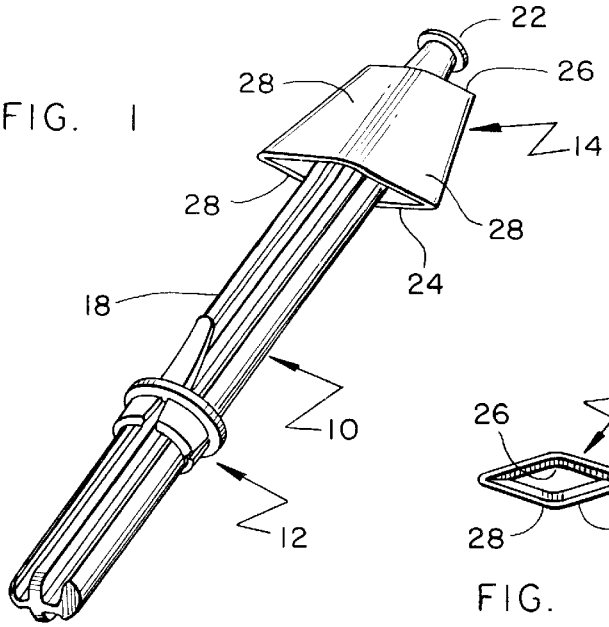
FIG. 1
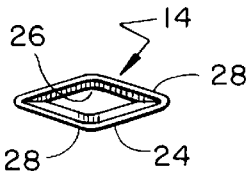
FIG. 5
FIG. 3
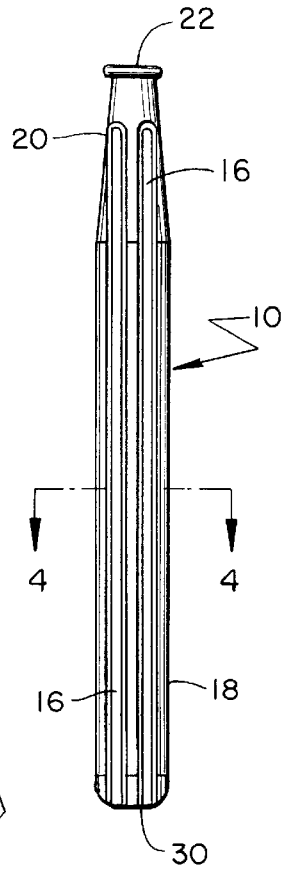
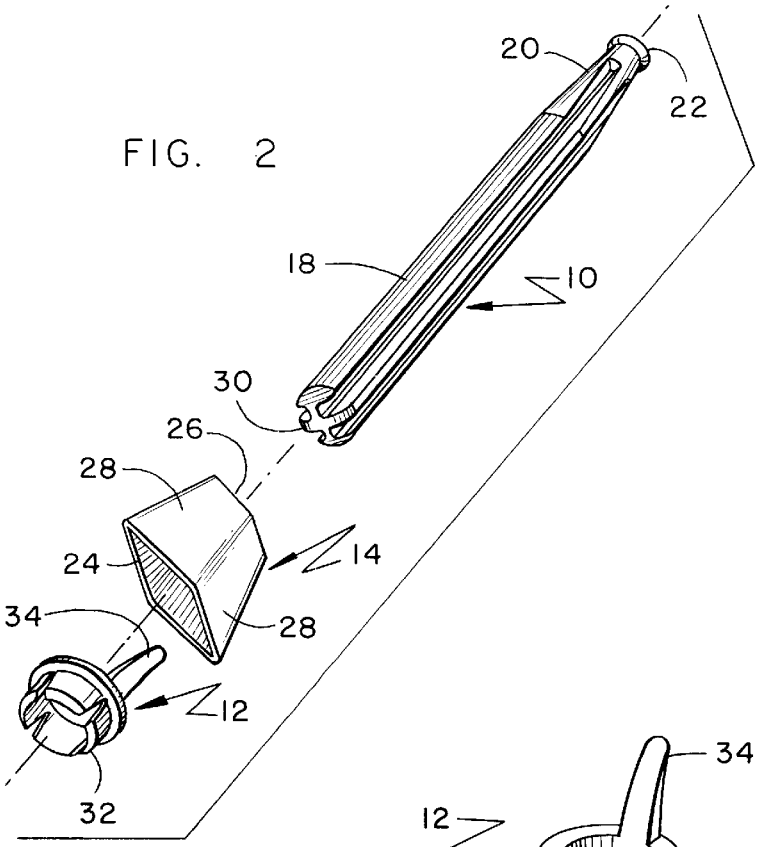
FIG. 2
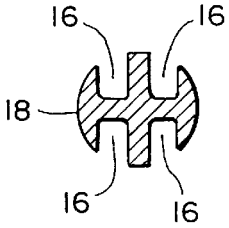
FIG. 4
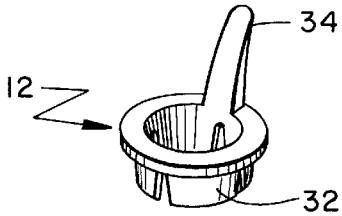
FIG. 6

HAIR CURLER

BACKGROUND OF THE INVENTION

Curlers in a variety of forms are widely used to produce different types of hair curls. The most common type of curler utilizes a cylindrical body over which the strands of hair are wound, dried and combed out after removal of the curlers. An example of this common type of hair curler is shown in Yates U.S. Pat. No. 2,258,920. With these simple cylindrical shaped curlers, it is difficult to form corkscrew-like or spiral curls since the hair must be wound in a helical or spiral form rather than being wound in layers, and in order to create uniform looking spiral curls, the winding of the hair around the curler has to be performed very carefully.

There have been designed and there are available curlers which make it easier to perform spiral curls and which will create a uniform fall of combed out curls after the hair is dried. For example, Ehmann U.S. Pat. No. 4,284,091 shows a cylindrical curler with helical ribs formed on it. Copola U.S. Pat. No. 4,211,245 also shows a curling device that is cylindrical in shape and which is formed with helical groves. Amendola U.S. Pat. No. 2,723,671 is designed to form spiral curls using a permanent waving solution. However, none of these prior art curling devices are designed so that the hair can be wound in two different ways in order to produce two different types of spiral curls. There is therefore a need for an improved hair curling device that can be used to produce spiral curls of the loose type as well as tight "corkscrew" spirals. Any such device should be relatively inexpensive and simple to use.

SUMMARY OF THE INVENTION

The hair curling device of the invention has an elongated cylindrical shaped rod formed with axially or longitudinally extending groves around the surface of the rod. The rod terminates in a tapered portion that has an annular shoulder at its outermost end. The device also includes a detachable funnel-shaped retaining member made of resilient material so it can be slipped over a shoulder on the tapered end of the rod to hold the ends of the hair in place after they are wound around the rod in a spiral fashion. An adjustable clip at the other end of the rod consists of an annular ring and clip which keeps the curler from unwinding at the roots of the hair and also keeps the curling device close to the head. The clip is slidably adjustable along the length of the rod.

BRIEF DESCRIPTION OF THE DRAWING

FIG. 1 is a perspective view of the curler of the invention and showing the components of the curler assembled;

FIG. 2 is an exploded view of the curler of FIG. 1;

FIG. 3 is an elevational view of one side of the curling rod;

FIG. 4 is a sectional view of the curling rod taken on the line 4—4 of FIG. 3;

FIG. 5 is an end view of the retaining member; and

FIG. 6 is a perspective view of the adjustable clip.

DESCRIPTION OF THE PREFERRED EMBODIMENT OF THE INVENTION

The hair curling device of the invention has three components: a curling rod 10, an adjustable clip 12 and a detachable retaining member 14. The three components are shown assembled in FIG. 1 and separately in the exploded view, FIG. 2.

Referring first to FIGS. 1–3, the curling rod 10 is an elongated cylindrical-shaped member that has a plurality of longitudinally or axially extending grooves 16 formed in the main body 18 of the rod 10. The grooves 16 provide for air circulation and fast drying of hair wound around the curling rod 10. The depth and shape of the groves 16 are best seen in FIG. 4. If desired, the grooves could be formed along radial lines of the rod 10.

The curling rod 10 also has a tapered portion 20 formed integrally with the main body 18, and the grooves extend along the portion 20 nearly to the end which terminates in an annular shoulder 22. If desired, the surface of the tapered portion 20 may be smooth rather than containing the grooves 16.

The hair is wound around the curling rod 10 in one of two ways described hereinafter. In both ways, the free ends of the hair are held in place by the funnel-shaped retaining member 14. Member 14 is made of stiff but flexible and therefore resilient material. Member 14 is open at both the lower end 24 and the upper end 26, the opening formed at the lower end 24 being larger than the opening in the upper end 26, thus creating a tapered body with a funnel shape. The sides 28 of the retaining member 14 are joined together to form a somewhat elliptical cross-sectional shape when the retaining member 14 is in its normal, collapsed condition. Because of the material from which the retaining member 14 is formed, if the sides 28 are grasped and pressed together, the openings in the lower end 24 and upper end 26 will become wider and more circular so that the member 14 can be slipped over the tapered portion 20 of the curling rod 10, the lower end 24 being passed first over the tapered portion 20 and the hair ends wound around it. The retaining member 14 is adapted to be slipped onto the end of the curling rod 10 until the upper and smaller end 26 passes over the shoulder 22. If the pressure on the sides 28 of the retaining member 14 is then released, member 14 will tend to return to the somewhat elliptical shape shown in FIG. 5 to grip and hold hair wound on the rod 10. The member 14 will be retained on the tapered portion 20 of the curling rod 10 by the shoulder 22. (See FIG. 1)

At the end 30 of the main body 18 opposite the tapered portion 20, the adjustable clip 12 is positioned at the desired place along the main body 18. The clip 12 has an annular shaped body 32 with a curved clip 34 affixed to the main body 32 and extending downwardly and outwardly. The purpose of the clip 12 is to keep the curling device from unwinding at the roots of the hair, and it also will keep the curling device positioned close to the head of the user once the hair has been wound around the device.

With prior art curling devices, if is necessary to start winding the hair from the roots, and since it is difficult for the user to keep the hair flat as it is wound on the curler, the curls formed will be loose and not of the tight corkscrew type. Using the curling device of the invention, the hair can be wound in two different ways to produce two different types of spiral curls, the tight corkscrew type as well as the looser type. If it is desired to produce a looser type of spiral curl, the hair, starting from the roots, is wound on the rod 10 from the untapered end 30 toward the tapered portion 20. The adjustable clip 12 is positioned near the end 30 and hooked over the roots of the selected portions of the hair. The hair is then wound in a spiral fashion around and down the rod 10 until the ends of the hair are wound around the tapered portion 20. The retaining member 14 is then grasped and squeezed and slid over the shoulder 22 and pushed upwardly until it covers the ends of the hair on the tapered portion 20. If in fact the ends of the hair stop somewhere along the main body 18, the retaining member 14 can be pushed upwardly until it covers those ends. The opening in the upper end 26 of the member is large enough to slip over the main body 18. The retaining member 14 can then be twisted to tighten the loose ends of the hair to make a better curl. The tapered shape of the retaining member 14 thus provides for a tighter curl and produces a more natural look in the finished hair. The tapered shape of the retaining member 14 also allows the member 14 to hold varying amounts and thicknesses of hair. After the hair has dried, the retaining member 14 is removed and the curling rod 10 is separated from the adjustable clip 12 which is then removed from the hair. The curling device of the invention will thus produce a loose type of spiral curl somewhere between a wave and a tight spiral curl.

If the user wishes to produce a tight corkscrew spiral curl, the ends of the hair are first wound around the tapered portion 20 of the curling rod 10. The ends of the hair are then rolled up an inch or so along the tapered portion 20, and the retaining member 14 is slipped over the shoulder 22 and twisted to hold the ends of the hair. The user then continues to wind the hair around the curling rod 10, rolling the hair upwardly and keeping the hair completely flat rather than allowing the hair to twist. When the hair is completely wound around the curling rod 10, the adjustable clip 12 is pushed down over the end 30 of the curling rod 10 so as to hold the device close to the scalp. Because the clip 12 is freely moveable along the curling rod 10, the roots of the hair may be anchored regardless of where they end up along the main body 18. After the hair has dried, the retaining member 14 and the adjustable clip 12 are removed and the curling rod 10 slipped out of the hair to form a tight corkscrew curl.

From the foregoing description, it is seen that the curling device of the invention is easy to use and can be used to produce different types of spiral curls. The groves 16 in the curling rod 10 allow for air circulation and rapid drying which is important when the device is being used for a set rather than a permanent. The cylindrical shape of the curling rod 10 with longitudinal grooves makes it easy to remove the rod 10 after the hair is set. With prior art devices containing helical groves, the hair is embedded in the groves which makes it more difficult to remove the curler from the hair. With prior art devices of the helical grove type, the user has to carefully unwind the curling rod which tends to take out some of the curl. The tapered body of the retaining member 14 is large enough to hold varying thicknesses of hair, but because of its tapered configuration, it will also hold small amounts of hair. This allows the curling device of the invention to be used to form the two different types of spiral curls as described above. The ends of the hair will be held inside of the retaining member 14 so that all of the hair is curled. The flexibility and resiliency of the retaining member 14 allows it to be used without damage to the ends of the hair since there is no excessive direct pressure on the hair, nor is there any snapping or pulling of the hair.

The tapered portion 20 of the curling rod 10 overcomes the tendency of the hair to relax more at its ends and not curl. With the smaller diameter of the tapered end 30, the ends are curled more tightly allowing for the natural relaxation that takes place.

The curling device of the invention can be used either for setting hair without perm solutions for a temporary curl, or with a perm solution for a permanent curl. The curling device of the invention thus can be used for different types of curls, has the adjustability and adaptability to be used for hairs of different lengths and thicknesses and is easy to use and easy to remove. The hair curling device of the invention thus has many advantages over known hair curling devices.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A hair curling device for creating spiral curls in the ends of hair on the head of a user, said device comprising: an elongated rod having an exterior surface with a plurality of longitudinally extending groves therein, the rod having a tapered portion at one end, a detachable retaining member of resilient material having an open lower end and an open upper end, the rod extending through the open ends of the retaining member to provide for slidable movement of the retaining member along the rod so as to hold the ends of hair in place after they are wound around the rod, and a retaining clip separate from the retaining member and positionable at the end of the rod opposite the end having the tapered portion for keeping the rod from unwinding from the hair and for holding the curling device close to the user's head.

2. The hair curling device of claim 1 in which the rod is generally cylindrical in shape.

3. The hair curling device of claim 2 in which the rod has a main body that is cylindrical in shape, and the longitudinally extending grooves extend along the tapered portion.

4. The hair curling device of claim 3 in which the retaining clip is movable relative to the rod along the length of the rod.

5. The hair curling device of claim 4 in which the retaining clip is slidably adjustable along the length of the rod and is comprised of an annular ring and a clip member extending outwardly from the annular ring.

6. The hair curling device of claim 3 in which the tapered portion of the rod terminates in an annular shoulder, and the open upper end of the retaining member is somewhat elliptical in shape and narrower in width than the annular shoulder when the member is in its normal condition, the resiliency of the retaining member providing for expansion of the width of the open upper end so that the retaining member can pass over the annular shoulder, whereby the shoulder holds the retaining member in place on the tapered portion of the rod.

7. The hair curling device of claim 6 in which retaining member is somewhat funnel shaped with the open lower end being larger than the open upper end.

8. A hair curling device for creating spiral curls in the ends of hair on the head of a user, said device comprising: an elongated rod having a main body with a tapered portion at one end terminating in an annular shoulder, the main body being generally cylindrical in shape and having an exterior surface with a plurality of longitudinally extending groves therein which grooves extend along the tapered portion, a detachable retaining member of resilient material having a open lower end and an open upper end, the open upper end of the retaining member being somewhat elliptical in shape and narrower in width than the annular shoulder when the retaining member is in its normal condition, the resiliency of the retaining member providing for expansion of the width of the open upper end so that the retaining member can pass over the annular shoulder whereby the shoulder holds the retaining member in place on the tapered portion of the rod, said detachable retaining member being joinable with and detachable from the tapered portion of the rod so as to hold the ends of hair in place after they are wound around the rod, and a retaining clip positionable at the end of the rod opposite the end having the tapered portion for keeping the rod from unwinding from the hair and for holding the curling device close to the user's head.

9. The hair curling device of claim 8 in which retaining member is somewhat funnel shaped with the open lower end being larger than the open upper end.

* * * * *